US009347126B2

(12) United States Patent
Pabla et al.

(10) Patent No.: US 9,347,126 B2
(45) Date of Patent: May 24, 2016

(54) PROCESS OF FABRICATING THERMAL BARRIER COATINGS

(71) Applicant: GENERAL ELECTRIC COMPANY, Schenectady, NY (US)

(72) Inventors: Surinder Singh Pabla, Greer, SC (US); Joshua Lee Margolies, Niskayuna, NY (US); Eklavya Calla, Karnataka (IN); Padmaja Parakala, Karnataka (IN)

(73) Assignee: General Electric Company, Schenectady, NY (US)

( * ) Notice: Subject to any disclaimer, the term of this patent is extended or adjusted under 35 U.S.C. 154(b) by 270 days.

(21) Appl. No.: 13/801,478

(22) Filed: Mar. 13, 2013

(65) Prior Publication Data

US 2013/0189441 A1 Jul. 25, 2013

Related U.S. Application Data

(63) Continuation-in-part of application No. 13/354,412, filed on Jan. 20, 2012, now abandoned.

(51) Int. Cl.
*C23C 4/12* (2006.01)
*C23C 24/04* (2006.01)

(52) U.S. Cl.
CPC .. *C23C 4/12* (2013.01); *C23C 24/04* (2013.01)

(58) Field of Classification Search
None
See application file for complete search history.

(56) References Cited

U.S. PATENT DOCUMENTS 4,055,705 A 10/1977 Stecura et al.
5,305,726 A 4/1994 Scharman et al.
5,320,909 A 6/1994 Scharman et al.
6,025,078 A 2/2000 Rickerby et al.
6,117,560 A 9/2000 Maloney
6,159,553 A 12/2000 Li et al.
6,187,453 B1 2/2001 Maloney
6,210,791 B1 4/2001 Skoog et al.

(Continued)

FOREIGN PATENT DOCUMENTS

EP 1642993 A1 5/2006
EP 2072634 A2 6/2009

(Continued)

OTHER PUBLICATIONS

European Search Report and Written Opinion issued in connection with corresponding EP Application No. 14158148.8-1362 dated Nov. 25, 2014.

(Continued)

*Primary Examiner* — Colin W Slifka
(74) *Attorney, Agent, or Firm* — McNees Wallace & Nurick LLC

(57) ABSTRACT

A process of fabricating a thermal barrier coating is disclosed. The process includes cold spraying a substrate with a feedstock to form a thermal barrier coating and concurrently oxidizing one or more of the substrate, the feedstock, and the thermal barrier coating. The cold spraying is in a region having an oxygen concentration of at least 10%. In another embodiment, the process includes heating a feedstock with a laser and cold spraying a substrate with the feedstock to form a thermal barrier coating. At least a portion of the feedstock is retained in the thermal barrier coating. In another embodiment, the process of fabricating a thermal barrier coating includes heating a substrate with a laser and cold spraying the substrate with a feedstock to form a thermal barrier coating.

20 Claims, 4 Drawing Sheets

(56) References Cited

U.S. PATENT DOCUMENTS

| | | | | |
|---|---|---|---|---|
| 6,352,788 | B1 | 3/2002 | Bruce | |
| 6,440,575 | B1 | 8/2002 | Heimberg et al. | |
| 6,485,848 | B1 | 11/2002 | Wang et al. | |
| 6,517,960 | B1 | 2/2003 | Wang | |
| 6,794,059 | B2 | 9/2004 | Shanker | |
| 6,808,799 | B2 | 10/2004 | Darolia et al. | |
| 6,875,529 | B1 | 4/2005 | Spitsberg et al. | |
| 6,887,595 | B1 | 5/2005 | Darolia et al. | |
| 7,166,373 | B2 | 1/2007 | Spitsberg et al. | |
| 7,255,940 | B2 | 8/2007 | Spitsberg et al. | |
| 7,291,408 | B2 | 11/2007 | Litton et al. | |
| 7,326,470 | B2 | 2/2008 | Ulion et al. | |
| 7,429,424 | B2 | 9/2008 | Boutwell et al. | |
| 7,445,434 | B2 | 11/2008 | Harada et al. | |
| 7,622,195 | B2 | 11/2009 | Schlichting et al. | |
| 7,622,411 | B2 | 11/2009 | Akiyama et al. | |
| 7,785,722 | B2 | 8/2010 | Freling et al. | |
| 2002/0102360 | A1* | 8/2002 | Subramanian | C23C 24/04 427/419.1 |
| 2005/0036891 | A1 | 2/2005 | Spitsberg et al. | |
| 2005/0238894 | A1 | 10/2005 | Gorman et al. | |
| 2007/0292624 | A1 | 12/2007 | Nagaraj et al. | |
| 2008/0107920 | A1 | 5/2008 | Rowe et al. | |
| 2009/0162632 | A1 | 6/2009 | Kirby et al. | |
| 2009/0239754 | A1* | 9/2009 | Kruger | C23C 24/04 505/473 |
| 2009/0269567 | A1 | 10/2009 | McCabe | |
| 2009/0297876 | A1 | 12/2009 | Schneiderbanger et al. | |
| 2009/0324989 | A1 | 12/2009 | Witz et al. | |
| 2010/0024279 | A1 | 2/2010 | Plato et al. | |
| 2010/0028549 | A1 | 2/2010 | Schlichting et al. | |
| 2010/0047063 | A1 | 2/2010 | Kulkarni et al. | |
| 2010/0093516 | A1 | 4/2010 | Malow et al. | |
| 2010/0129673 | A1 | 5/2010 | Lee | |
| 2010/0159262 | A1 | 6/2010 | Fu et al. | |
| 2010/0159270 | A1 | 6/2010 | Fu et al. | |
| 2010/0326512 | A1* | 12/2010 | Berek | C23C 24/04 136/256 |
| 2010/0327213 | A1 | 12/2010 | Tolpygo | |
| 2011/0052824 | A1* | 3/2011 | Venkatachalapathy | B05B 7/1486 427/421.1 |
| 2011/0135895 | A1 | 6/2011 | Neal et al. | |
| 2011/0206817 | A1* | 8/2011 | Arnold | A23L 3/3454 426/335 |

FOREIGN PATENT DOCUMENTS

| | | | |
|---|---|---|---|
| JP | 2006124735 | | 5/2006 |
| JP | 2006298695 | | 11/2006 |
| WO | 02061177 | A2 | 8/2002 |
| WO | 2004007787 | A1 | 1/2004 |
| WO | 2006022740 | A1 | 3/2006 |
| WO | 2008606992 | A2 | 5/2008 |
| WO | 2010069912 | A1 | 6/2010 |
| WO | 2010071720 | A1 | 6/2010 |

OTHER PUBLICATIONS

Ogawa et al., "Repair of Turbine Blades Using Cold Spray Technique", Advances in Gas Turbine Technology, vol. No. 21, pp. 499-526, Nov. 4, 2011.

Christoulis et al., "Laser-Assisted Cold Spray (LACS)", In: Dumitras D C: "Nd YAG Laser", vol. No. 5, pp. 60-96, Mar. 9, 2012.

European Search Report and Written Opinion issued in connection with corresponding EP Application No. 14158148.8-1362 on Jul. 8, 2014.

* cited by examiner

PROCESS OF FABRICATING THERMAL BARRIER COATINGS

RELATED APPLICATION

This application is a continuation-in-part of and claims priority to U.S. patent application Ser. No. 13/354,412, filed Jan. 20, 2012, titled "Process of Fabricating a Thermal Barrier Coating and an Article Having a Cold Sprayed Thermal Barrier Coating," which is hereby incorporated by reference in its entirety.

FIELD OF THE INVENTION

The present invention is directed to a process of fabricating thermal barrier coatings and turbine components having thermal barrier coatings. More specifically, the present invention is directed to cold spray to form thermal barrier coatings.

BACKGROUND OF THE INVENTION

Many systems, such as those in gas turbines, are subjected to thermally, mechanically and chemically hostile environments. For example, in the compressor portion of a gas turbine, atmospheric air is compressed to 10-25 times atmospheric pressure, and adiabatically heated to a temperature of from about 800° F. to about 1250° F. in the process. This heated and compressed air is directed into a combustor, where it is mixed with fuel. The fuel is ignited, and the combustion process heats the gases to very high temperatures, in excess of about 3000° F. These hot gases pass through the turbine, where airfoils fixed to rotating turbine disks extract energy to drive the fan and compressor of the turbine, and the exhaust system, where the gases provide sufficient energy to rotate a generator rotor to produce electricity. Tight seals and precisely directed flow of the hot gases provide operational efficiency. To achieve such tight seals in turbine seals and providing precisely directed flow can be difficult to manufacture and expensive.

To improve the efficiency of operation of turbines, combustion temperatures have been raised and are continuing to be raised. To withstand these increased temperatures, thermal barrier coatings (TBC) are often used as sealing structures for hot gas path components. An ability of the TBC to protect the hot gas path components from the rising temperatures is limited by a thermal conductivity of the TBC. The lower the thermal conductivity of the TBC, the higher the temperature the TBC can withstand.

An increased porosity in the TBC may decrease the thermal conductivity of the TBC. However, current methods of TBC deposition, including electron beam physical vapor deposition (EBPVD) and air plasma spraying (APS), are unable to form the desired porosity while maintaining a required mechanical strength in the TBC. Additionally, current TBC chemistries that have low K value constituents, like lanthana for example, cannot be deposited by APS to the thicknesses required for effective TBC layer due to the formation of a glass phase that disrupts the spraying process.

A fabrication process and an article that do not suffer from one or more of the above drawbacks would be desirable in the art.

BRIEF DESCRIPTION OF THE INVENTION

In an exemplary embodiment, a process of fabricating a thermal barrier coating includes cold spraying a substrate with a feedstock to form a thermal barrier coating and concurrently oxidizing one or more of the substrate, the feedstock, and the thermal barrier coating. The cold spraying is in a region having an oxygen concentration of at least 10%.

In another exemplary embodiment, a process of fabricating a thermal barrier coating includes heating a feedstock with a laser and cold spraying a substrate with the feedstock to form a thermal barrier coating. At least a portion of the feedstock is retained in the thermal barrier coating.

In another embodiment, a process of fabricating a thermal barrier coating includes heating a substrate with a laser and cold spraying the substrate with a feedstock to form a thermal barrier coating.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a process of fabricating a thermal barrier coating. Embodiments of the present disclosure, for example in comparison to processes not employing one or more of the features disclosed herein, provide increased ceramic retention in deposits, increased oxide content of the deposits, graded porosity layers, mica fillers, increased porosity, decreased thermal conductivity value, controlled thermal barrier coating microstructure, and combinations thereof.

Figure 1:
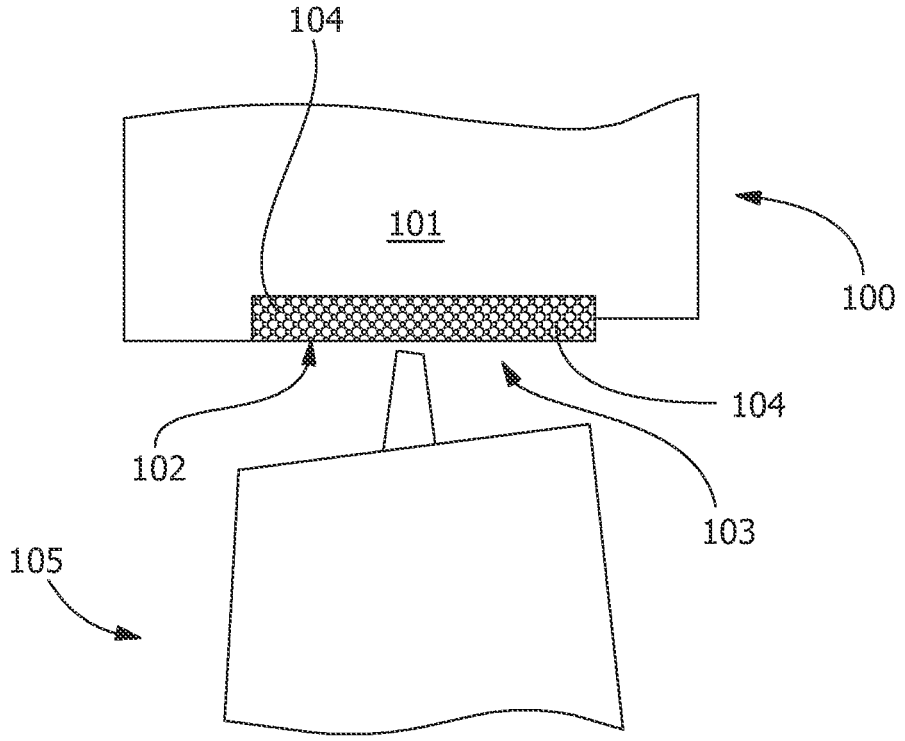
FIG. 1 shows a seal arrangement having one layer positioned between a shroud and a blade according to an embodiment of the disclosure.
Figure 2:
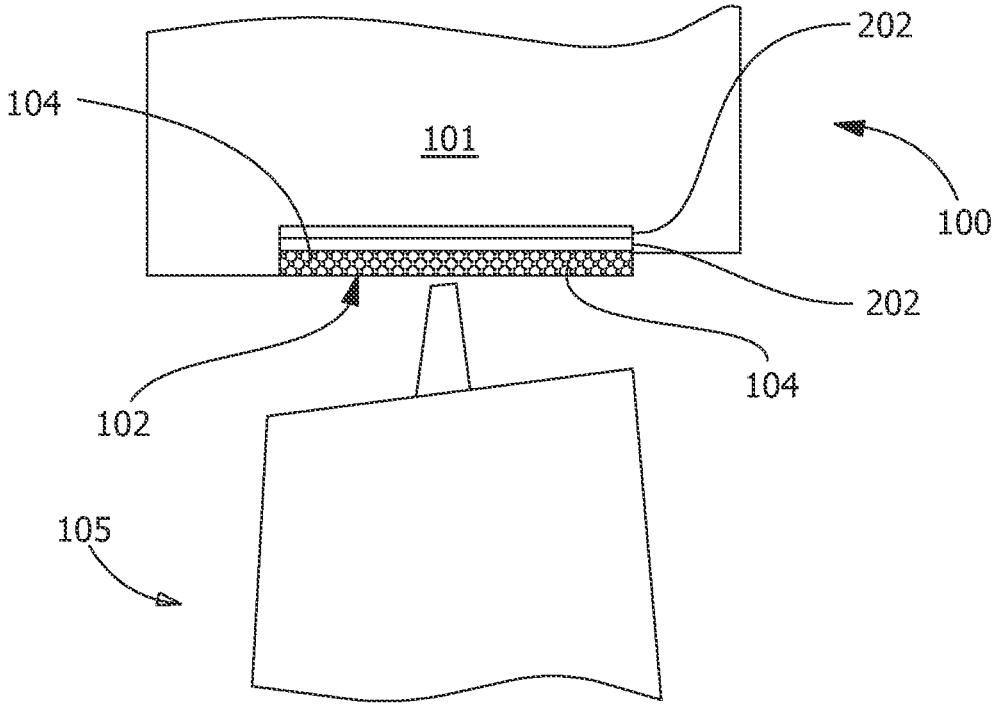
FIG. 2 shows a seal arrangement having multiple layers positioned between a shroud and a blade according to an embodiment of the disclosure.

FIGS. 1 and 2 show articles 100, such as a turbine shroud positioned adjacent to a turbine blade 105, having a thermal barrier coating 102. In one embodiment, the thermal barrier coating 102 forms a turbine component, such as a turbine seal. The thermal barrier coating 102 is positioned directly on a substrate 101 of the article 100, as shown in FIG. 1, or is positioned on one or more intermediate layers 202 on the substrate 101, as shown in FIG. 2. In one embodiment, the thermal barrier coating 102 forms a low thermal conductivity portion in comparison to other portions of the article 100.

The article 100 is any suitable metallic component, such as a stationary component or a rotating part. Suitable metallic components include, but are not limited to, compressor components, turbine components, turbine blades, and turbine buckets. As used herein, the term "metallic" is intended to encompass metals, alloys, composite metals, intermetallic materials, or any combination thereof. In one embodiment, the article 100 includes or is stainless steel. In another embodiment, the article 100 includes or is a nickel-based alloy. Other suitable alloys include, but are not limited to, cobalt-based alloys, chromium based alloys, carbon steel, and combinations thereof. Suitable metals include, but are not limited to, titanium, aluminum, and combinations thereof.

The thermal barrier coating 102 is positioned on any suitable portion or surface of the article 100. In one embodiment, the thermal barrier coating 102 is a portion of the article 100, such as, a hot gas path of a turbine, a fillet, the turbine seal, a compressor seal, a labyrinth seal, a brush seal, a flexible seal, a damping mechanism, a cooling mechanism, bucket interiors, pistons, heat exchangers, or combinations thereof.

Figure 4:
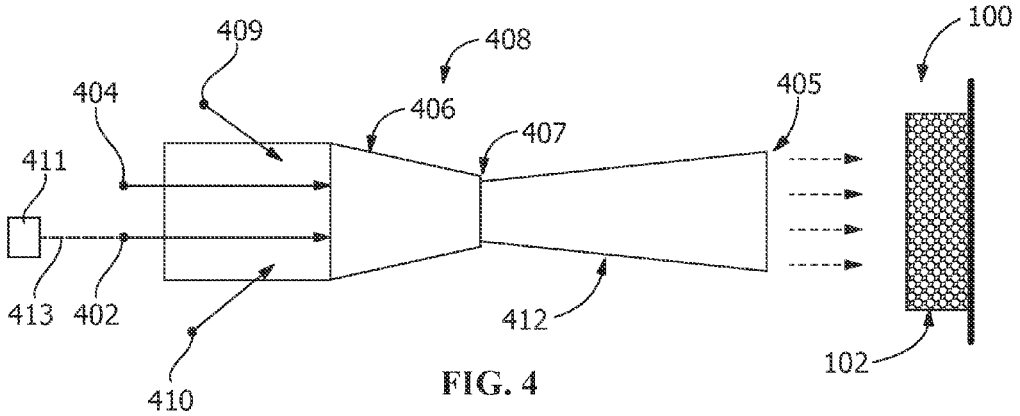
FIG. 4 shows a schematic view of an apparatus for forming an article having a metallic structure applied according to an embodiment of the process of the disclosure.

The thermal barrier coating 102 is formed by cold spraying of a solid/powder feedstock 402 (see FIGS. 4 and 5) in a region 103 having an oxygen concentration of at least 10%. In one embodiment, the oxygen concentration is above about 50%. In one embodiment, the oxygen concentration is above about 70%. The feedstock 402 includes, but is not limited to, ceramic particles and a binder 404 (FIG. 4). In one embodiment, the thermal barrier coating 102 includes a network of pores 104. In one embodiment, the pores 104 are have limited visual discernibility and/or have a fine porosity. In another embodiment, the pores 104 are complex and do not have a consistent geometry, similar to steel wool, and/or have a coarse porosity. The pores 104 are any suitable size and within any suitable density. Suitable sizes of the pores 104 are between about 1 and about 100 microns, between about 10 and about 50 microns, between about 30 and about 40 microns, between about 50 and about 100 microns, between about 50 and about 70 microns, or a combination thereof. Suitable densities of the pores 104 are between about 5% and about 85%, about 15% and about 75%, about 15% and about 25%, about 25% and about 75%, about 2% and about 15%, and combinations and sub-combinations thereof.

Referring to FIG. 2, in one embodiment, the thermal barrier coating 102 is positioned on two of the intermediate layers 202, one of which is positioned on the substrate 101 of the article 100. In further embodiments, the metallic structure is positioned on three, four, five, or more of the intermediate layers 202.

Figure 3:
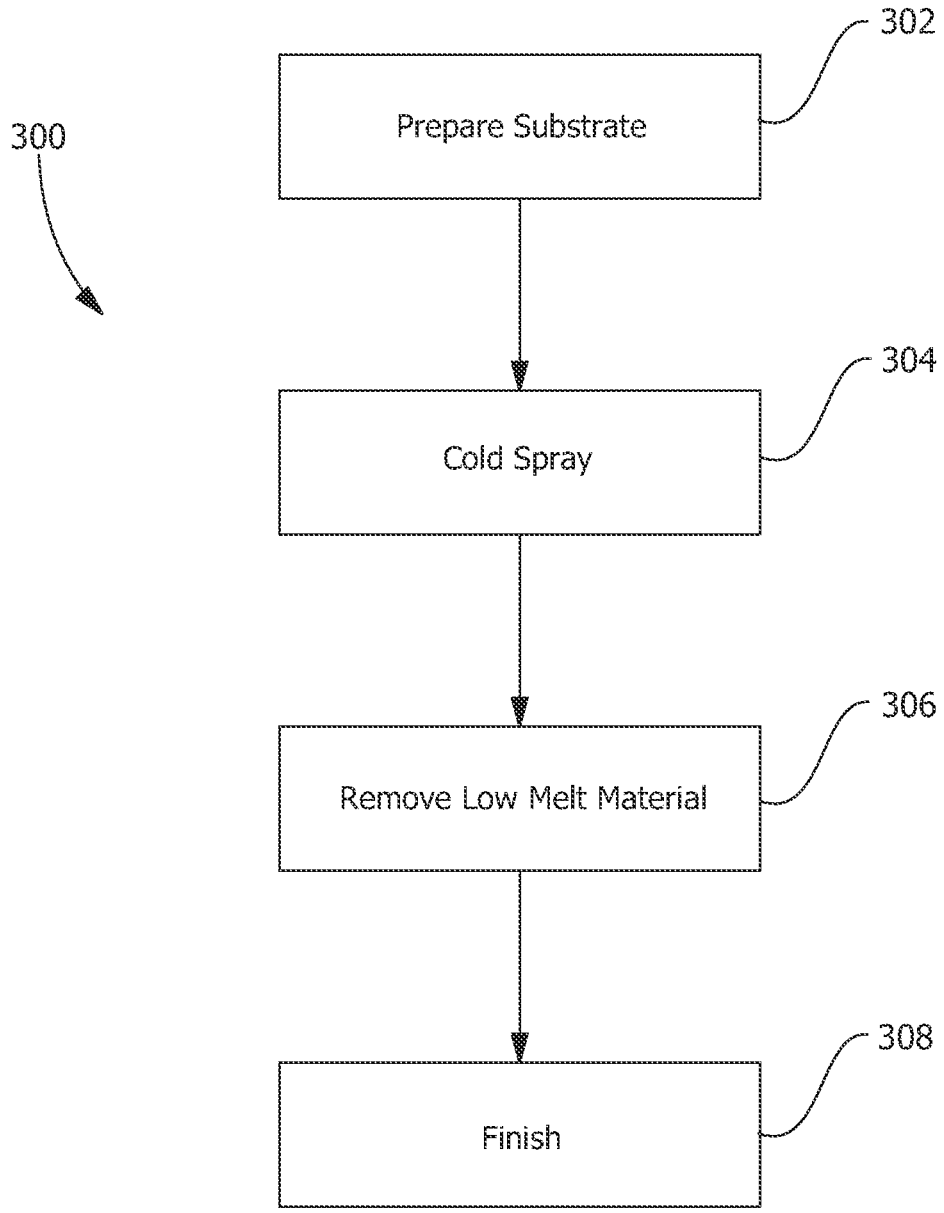
FIG. 3 shows a flow diagram of an embodiment of a process of applying a metallic structure according to the disclosure.

Referring to FIG. 3, in an exemplary process 300 of applying the thermal barrier coating 102, the article 100 is prepared (step 302), for example, by cleaning the surface of the article 100. The thermal barrier coating 102 is then applied to the article 100 by cold spray (step 304). The cold spraying (step 304) includes spraying the feedstock 402 (see FIGS. 4 and 5) and the processing takes place mostly in a solid condition with less heat than processes such as welding or brazing. In one embodiment, the cold spraying (step 304) applies the thermal barrier coating 102 to a predetermined region. In one embodiment, the predetermined region of the thermal barrier coating 102 is capable of being at a tighter tolerance than otherwise possible without use of masking. In one embodiment, the thermal barrier coating 102 is applied without using masking and is capable of being reproduced. In one embodiment of the article 100, the thermal barrier coating 102 is or includes a reproducible feature that is capable of being replicated without masking. In one embodiment, the thermal barrier coating 102 has a tensile adhesion strength greater than a predetermined amount, for example, greater than 1000 PSI, greater than 3000 PSI, greater than 5000 PSI, or greater than 10,000 PSI.

In one embodiment, the solid feedstock 402 includes ceramic particles, such as yttrium stabilized zirconium, ytterbium zirconium, pyrochlores, other suitable ceramic particles, or combinations thereof. For example, in one embodiment, the ceramic particles include rare earth stabilized zirconia, stabilized by a rare earth metal selected from the group consisting of Y, Yb, Gd, Nd, La, Sc, Sm, and combinations thereof. In another embodiment, the ceramic particles include non-rare earth stabilized zirconia, stabilized by a material selected from the group consisting of Ca, MG, Ce, Al, and combinations thereof. In one embodiment, the solid feedstock 402 includes ceramic particles clad in a binder or adhesive. In one embodiment, the ceramic particles in the solid feedstock 402 have a predetermined maximum dimension, for example, less than about 20 micrometers, less than about 10 micrometers, between about 5 micrometers and about 20 micrometers, between about 5 micrometers and about 10 micrometers, at about 10 micrometers, at about 5 micrometers, or any suitable combination or sub-combination thereof. In one embodiment, the solid feedstock 402 includes sintering aids, such as $Al_2O_3$, $SiO_2$, other suitable sintering aids, or combinations thereof.

In one embodiment, the solid feedstock 402 includes mica. Mica is a silicate (phyllosilicate) mineral that includes several closely related materials having close to perfect basal cleavage. Micas have the general formula $X_2Y_{4-6}Z_8O_{20}(OH,F)_4$. Common micas include, but are not limited to, biotite, lepidolite, muscovite, phlogopite, zinnwaldite, and combinations thereof. Mica decomposes between temperatures of about 850° C. to about 1200° C. In one embodiment, mica is used as a filler material below its decomposition temperature. In one embodiment, mica is heated above its decomposition temperature, forming the pores 104 in the thermal barrier coating 102.

In one embodiment, the solid feedstock 402 is prepared by a method including, but not limited to, mixing, milling, spray drying, coating, contacting the feedstock with a plasma flame, or a combination thereof. In another embodiment, the solid feedstock 402 is prepared by coating the ceramic particles with a metallic material, for example, using an electroless method to coat the ceramic particles with nickel. In another embodiment, the solid feedstock 402 is prepared by passing the solid feedstock 402 material through a plasma flame and collecting the sprayed material.

Referring to FIG. 4, in one embodiment, the solid feedstock 402 is mixed with the binder 404 within or prior to a converging portion 406 of a converging-diverging nozzle 408. In one embodiment, the solid feedstock 402 is a substantially homogenous mixture of the ceramic particles, and the binder 404. The binder 404 has a melting point lower than the ceramic particles. Additionally or alternatively, the binder 404 has a ductility greater than the ceramic particles (at conditions of cold spray). In one embodiment, the solid feedstock 402 is pre-mixed with the binder 404 providing further adjustability, for example, at any suitable volume concentration. Suitable volume concentrations for the binder 404 are between about 5% and about 90%, between about 5% and about 10%, between about 5% and about 15%, between about 5% and about 20%, between about 5% and about 30%, between about 5% and about 50%, between about 5% and about 60%, between about 5% and about 70%, between about 5% and about 80%, between about 10% and about 90%, between about 20% and about 90%, between about 30% and about 90%, between about 40% and about 90%, between about 50% and about 90%, between about 60% and about 90%, between about 70% and about 90%, between about 80% and about 90%, between about 30% and about 60%, between about 40% and about 50%, between about 10% and about 15%, or any suitable combination or sub-combination thereof.

The binder 404 is a polymer, a mixture of polymers, a non-polymeric material, a metallic material, any material suitable for use in cold spray applications and/or with thermal barrier coatings, or combinations thereof. In one embodiment, the binder 404 is or includes polyester. In other embodiments, the binder 404 is or includes titanium, aluminum, nickel, cobalt, iron, alloys thereof, polyamide (nylon), nylon with glass fiber reinforcement, poly butylene terepthalate (PBT), polypropylene (PP), polyethylene (PE), polyphenylene sulfide (PPS), a blend of polyphenylene oxide and polystyrene, or combinations thereof. For example, in one embodiment, a combination of polymers is based upon melting points.

Figure 6:
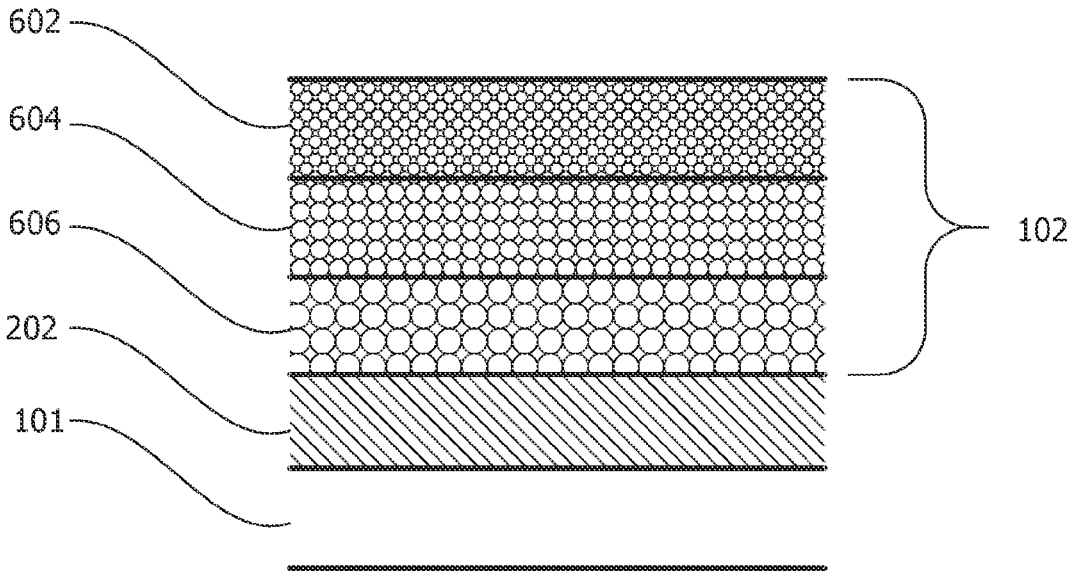
FIG. 6 shows an article with multiple layers of a thermal barrier coating according to an embodiment of the disclosure.

Referring to FIG. 6, in one embodiment, the thermal barrier coating 102 includes several layers each having the binder 404, for example, an exterior thermal barrier layer 602, an intermediate thermal barrier layer 604, and an interior thermal barrier layer 606. In this embodiment, the volume concentration of the binder 404 is adjusted, thereby adjusting the porosity of the thermal barrier coating 102 as a whole. For example, in one embodiment, the external thermal barrier layer 602 includes binder of a first density (for example, about 25%), the intermediate thermal barrier layer 604 includes binder of a second density (for example, a greater amount than the first density and/or between about 25% and about 40%), and the interior thermal barrier layer 606 includes binder of a third density (for example, a greater amount than the second density and/or between about 40 and about 75%). In one embodiment, the thermal barrier coating 102 and/or one or more of the layers of the thermal barrier coating is/are substantially devoid of metal or metallic materials.

In one embodiment, the thermal barrier coating 102 includes, but is not limited to, low thermal conductivity chemistries such as 68.9 wt % $Yb_2O_3$, balance $ZrO_2$, high Y 55 wt % $ZrO_2$, or combinations thereof. In one embodiment, the thermal barrier coating 102 includes, but is not limited to, ultra low thermal conductivity chemistries such as 30.5 wt % $Yb_2O_3$, 24.8 wt % $La_2O_3$, balance $ZrO_2$, and combinations thereof.

The cold spraying (step 304) forms the thermal barrier coating 102 by impacting the solid feedstock 402 particles. The cold spraying (step 304) substantially retains the phases and microstructure of the solid feedstock 402. In one embodiment, the cold spraying (step 304) is continued until the thermal barrier coating 102 is within a desired thickness range or slightly above the desired thickness range (to permit finishing), for example, between about 1 mil and about 2000 mils, between about 1 mil and about 100 mils, between about 10 mils and about 20 mils, between about 20 mils and about 30 mils, between about 30 mils and about 40 mils, between about 40 mils and about 50 mils, between about 20 mils and about 40 mils, or any suitable combination or sub-combination thereof.

Figure 5:
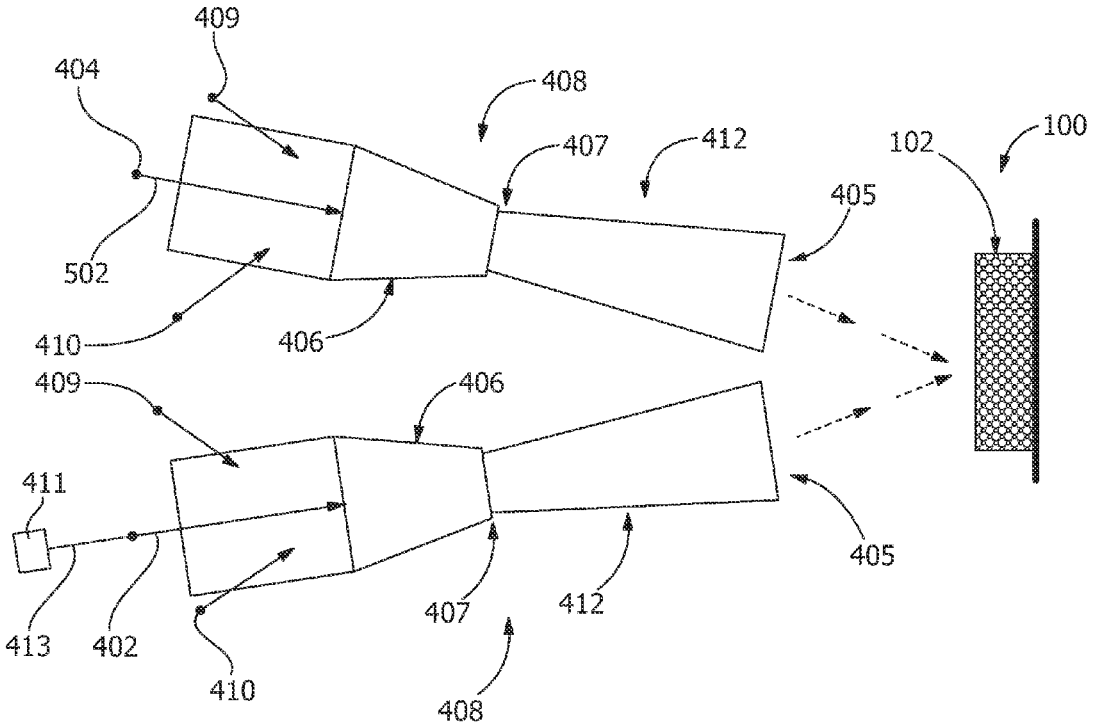
FIG. 5 shows a schematic view of an apparatus for forming an article having a metallic structure applied according to an embodiment of a process of the disclosure.

Referring to FIG. 4 and FIG. 5, in one embodiment, the solid feedstock 402 is pre-heated with a laser beam 413 from a laser 411 prior to cold spraying (step 304). The pre-heating of the solid feedstock 402 increases retention of the solid feedstock 402 in the thermal barrier coating 102 deposits. In another embodiment (not shown), the laser 411 is utilized to heat the substrate 101 prior to cold spraying (step 304). In another embodiment, the laser 411 is utilized to heat the substrate 101 after the cold spraying (step 304). Heating the substrate 101 with the laser 411 increases a temperature surrounding the substrate 101, also leading to increased retention of the feedstock 402 in the thermal barrier coating 102. The heating of the substrate 101 with the laser 411 also increases an oxygen concentration surrounding the substrate.

An increased retention of the feedstock 402 forms an increased porosity in the thermal barrier coating 102. In one embodiment, the increased porosity in the thermal barrier coating 102 decreases the thermal conductivity of the thermal barrier coating 102. For example, in one embodiment, the porosity of the thermal barrier coating 102 is between about 20% and about 40%, between about 20% and about 30%, between about 25% and about 35%, between about 30% and about 35%, between about 30% and about 40%, or any suitable combination or sub-combination thereof.

In one embodiment, the cold spraying (step 304) includes accelerating the solid feedstock 402 through the converging-diverging nozzle 408. The solid feedstock 402 is accelerated to at least a predetermined velocity or velocity range, for example, based upon the below equation for the converging-diverging nozzle 408 as is shown in FIG. 4:

$$\frac{A}{A^*} = \frac{1}{M}\left[\frac{2}{\gamma+1}\right]\left[1+\left(\frac{\gamma-1}{2}\right)M^2\right]^{\frac{\gamma+1}{2(\gamma-1)}} \quad \text{(Equation 1)}$$

In Equation 1, "A" is the area of nozzle exit 405 and "A*" is the area of nozzle throat 407. "γ" is the ratio $C_p/C_v$ of the process gas 409 being used ($C_p$ being the specific heat capacity at constant pressure and $C_v$ being the specific heat capacity at constant volume). The gas flow parameters depend upon the ratio of A/A*. When the nozzle 408 operates in a choked condition, the exit gas velocity Mach number (M) is identifiable by the equation 1. Gas having higher value for "γ" results in a higher Mach number. The parameters are measured/monitored by sensors 410 positioned prior to the converging portion 406. The solid feedstock 402 impacts the article 100 at the predetermined velocity or velocity range and the solid feedstock 402 bonds to the article 100 to form the thermal barrier coating 102.

In one embodiment, the solid feedstock 402 is cold sprayed (step 304) through the converging-diverging nozzle 408 using a process gas 409. The process gas 409 includes, but is not limited to, helium, nitrogen, oxygen, air, or combinations thereof. In one embodiment the process gas 409 provides an increase in oxygen concentration in the region 103 where the thermal barrier coating 102 is formed. In another embodiment, an inlet gas provides an increase in oxygen concentration in the region 103 where the thermal barrier coating 102 is formed.

The increase in oxygen concentration increases an oxidation of the metallic components in the thermal barrier coating 102. An oxide concentration in the thermal barrier coating 102 is increased by the increase in the oxidation of the metallic components.

The nozzle 408 is positioned a predetermined distance from the article 100, for example, between about 10 mm and about 150 mm, between about 10 mm and about 50 mm, between about 50 mm and about 100 mm, between about 10 mm and about 30 mm, between about 30 mm and about 70 mm, between about 70 mm and about 100 mm, or any suitable combination or sub-combination thereof.

In one embodiment, the cold spraying (step 304) includes impacting the solid feedstock 402 in conjunction with a second feedstock, for example, including the binder 404. Referring to FIG. 4, the binder 404 is injected with the solid feedstock 402, injected separate from the solid feedstock 402 but into the same nozzle 408, injected into a separate nozzle 408, or injected into a diverging portion 412 of the same nozzle 408 or the separate nozzle 408. In an embodiment with the binder 404 injected into the diverging portion 412, the effect of heat, such as degradation of the binder 404, from a processing gas is reduced or eliminated. In one embodiment, the binder 404 includes a material susceptible to damage, such as degradation from the heat of the processing gas, up to about 1500° C. The injection in the diverging portion 412 reduces or eliminates such degradation. Another embodiment uses a single feedstock, where the material is a ceramic powder, with each individual particle clad in the binder 404.

Referring to FIG. 5, in one embodiment, the cold spraying (step 304) includes accelerating the solid feedstock 402 and a separate feedstock 502 of the binder 404 to at least a predetermined velocity or velocity range, for example, based upon the equation 1. In one embodiment, the cold spraying (step 304) corresponding to FIG. 5 involves nozzles 408 designed with a combined A/A* ratio to suit spraying a particular material (either a metallic or low melting). In a further embodiment, the cold spraying (step 304) uses different gases in different nozzles 408 and/or includes relative adjustment of other parameters. In one embodiment, multiple nozzles 408 are used to handle incompatibility associated with feedstock having a metallic phase and feedstock having a low melting phase, such as the separate feedstock 502 and the binder 404. The solid feedstock 402 and the separate feedstock 502 impact the article 100 at the predetermined velocity or velocity range and the solid feedstock 402 bonds to the article 100 with the separate feedstock 502 and/or the binder 404 being entrained within the solid feedstock 402 and/or also bonding to the article 100. The parameters are measured/monitored by sensors 410 positioned prior to the converging portion 406.

In a further embodiment, the porosity of the thermal barrier coating 102 is controlled by varying an amount of the binder 404 applied in comparison to an amount of the solid feedstock 402 applied. Similarly, in one embodiment, the thermal conductivity of the thermal barrier coating 102 is adjusted. In one embodiment, the amount of the binder 404 is adjustably controlled by varying the amount of the binder 404 applied in comparison to the amount of the solid feedstock 402 while cold spraying (step 304). In this embodiment, the porosity of the thermal barrier coating 102 varies based upon these amounts. In a similar embodiment, multiple layers are formed by cold spraying (step 304) more than one application of the binder 404 (or another low-melt material) and the solid feedstock 402 with more than one relative amount of the binder 404 in comparison to the solid feedstock 402.

For example, in one embodiment, the intermediate layer 202 (see FIG. 2) positioned proximate to the substrate 101 or abutting the substrate 101 is less porous than the intermediate layer 202 (see FIG. 2) positioned distal from the substrate 101 or at the surface of the thermal barrier coating 102 by the amount of the binder 404 applied to form the intermediate layer proximate to the substrate 101 being lower than the amount of the binder 404 applied to form the intermediate layer distal from the substrate 101.

Referring again to FIG. 3, in one embodiment, the process 300 continues after the cold spraying (step 304) by removing (step 306) the binder 404. In one embodiment, excess amounts of the binder 404 are removed (step 306) by heating the binder 404 and the solid feedstock 402 after the cold spraying (step 304) to evaporate, burn, dissolve and/or sublime the excess amounts of the binder 404. The removing (step 306) of the excess amounts of the binder 404 forms the pores 104.

In another embodiment, the process 300 continues after the cold spraying (step 304) by further oxidizing metallic components in at least a portion of the thermal barrier coating 102. The further oxidation increases the oxide content of the thermal barrier coating 102. In one embodiment, further oxidation is performed by heating the thermal barrier coating 102 to a temperature sufficient to cause oxidation. In one embodiment, a chemical treatment is used to cause oxidation in the thermal barrier coating 102. The oxide concentration in the thermal barrier coating 102 is increased by the oxidizing.

In one embodiment, the process 300 includes finishing (step 308) the thermal barrier coating 102 and/or the article 100, for example, by grinding, machining, shot peening, or otherwise processing. Additionally or alternatively, in one embodiment, the process 300 includes sintering the thermal barrier coating 102, treating (for example, heat treating) the thermal barrier coating 102, or other suitable process steps. In one embodiment, the treating converts the thermal barrier coating 102 from a composite coating into a ceramic coating. In a further embodiment, the ceramic coating includes titania, alumina, nickel oxide, cobalt oxide, iron oxide, nickel-cobalt oxide, nickel-iron oxide, cobalt-iron oxide, nickel-ytrria oxide, cobalt-ytrria oxide, iron-ytrria oxide, polyamide, nylon with glass fiber reinforcement, poly butylene terepthalate, polypropylene, polyethylene, polyphenylene sulfide, a blend of polyphenylene oxide and polystyrene, or a combination thereof.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A process of fabricating a thermal barrier coating, the process comprising:

cold spraying a substrate with a feedstock to form a thermal barrier coating on the substrate; and concurrently oxidizing one or more of the substrate, the feedstock, and the thermal barrier coating;

wherein the cold spraying is in a region above the substrate having an oxygen concentration of at least 10%.

2. The process of claim 1, wherein the oxygen concentration is provided by a process gas.

3. The process of claim 2, wherein the process gas is air.

4. The process of claim 1, wherein the oxygen concentration is provided by an inlet gas.

5. The process of claim 1, wherein the oxygen concentration is above about 50%.

6. The process of claim 1, wherein the oxygen concentration is above about 70%.

7. The process of claim 1, wherein an oxide concentration is increased by an increase in the oxygen concentration.

8. The process of claim 1, further comprising oxidizing at least a portion of the thermal barrier coating.

9. The process of claim 8, wherein the oxidizing at least a portion of the thermal barrier coating includes baking in an oxygen containing atmosphere.

10. The process of claim 8, wherein the oxidizing at least a portion of the thermal barrier coating includes chemical treatment.

11. The process of claim 1, wherein the feedstock comprises mica.

12. The process of claim 11, wherein a decomposition of the mica forms porosity in the thermal barrier coating.

13. The process of claim 1, wherein the thermal barrier coating has graded porosity.

14. The process of claim 1, wherein the feedstock further comprises a homogenous mixture of ceramic particles and a binder.

15. The process of claim 14, wherein the ceramic particles comprise a material selected from the group consisting of 68.9 wt % $Yb_2O_3$, balance $ZrO_2$; high Y 55 wt %, balance $ZrO_2$; and combinations thereof.

16. The process of claim 14, wherein the ceramic particles comprise a material selected from the group consisting of 30.5 wt % $Yb_2O_3$, balance $ZrO_2$; 24.8 wt % $La_2O_3$, balance $ZrO_2$; and combinations thereof.

17. The process of claim 1, further comprising heating the feedstock prior to the cold spraying.

18. The process of claim 1, further comprising heating the substrate prior to the cold spraying.

19. The process of claim 1, further comprising heating the feedstock with a laser.

20. The process of claim 1, further comprising heating the substrate with a laser.

* * * * *